US005924613A

United States Patent [19]

Johnson et al.

[11] Patent Number: 5,924,613

[45] Date of Patent: Jul. 20, 1999

[54] SHELL HOLDER SYSTEM

[76] Inventors: J. Evan Johnson, 11881 Thornhill Rd., Eden Prairie, Minn. 55344; Kurt Bauman, 15531 50th St. N.E., Rogers, Minn. 55374; David L. Smith, 1537 Skyline Court, Eagan, Minn. 55121

[21] Appl. No.: 08/420,480

[22] Filed: Apr. 12, 1995

[51] Int. Cl.[6] ..... F42B 39/02; A45F 5/00

[52] U.S. Cl. ..... 224/195; 224/245; 224/251; 224/272; 224/931; 224/678; 2/94

[58] Field of Search ..... 224/272, 271, 224/195, 240, 245, 242, 251, 239, 547, 931, 223, 665, 678, 679, 684; 211/94, 162, 69; 2/94, 102

[56] References Cited

U.S. PATENT DOCUMENTS

| | | | |
|---|---|---|---|
| 111,450 | 1/1871 | Hayden . | |
| 162,055 | 4/1875 | Goss . | |
| 169,639 | 11/1875 | Henning . | |
| 373,681 | 11/1887 | O'Connor . | |
| 394,376 | 12/1888 | Kelton | 224/245 |
| 954,006 | 4/1910 | Savage . | |
| 1,073,721 | 9/1913 | Uren . | |
| 2,371,433 | 3/1945 | Davis | 211/162 |
| 2,987,229 | 5/1961 | Leclerc . | |
| 2,995,280 | 8/1961 | Thierry | 224/239 |
| 3,153,500 | 10/1964 | Pachmayr et al. | 224/245 |
| 3,190,514 | 6/1965 | Spilman . | |
| 3,346,154 | 10/1967 | Bishop | 224/223 |
| 3,668,802 | 6/1972 | Benward | 224/245 |
| 3,702,671 | 11/1972 | Cirillo . | |
| 3,917,135 | 11/1975 | Christensen . | |
| 4,094,415 | 6/1978 | Larson | 211/94 |
| 4,797,040 | 1/1989 | Hibbard | 211/69 |
| 4,843,649 | 7/1989 | Jewell et al. . | |
| 5,186,326 | 2/1993 | Peckels et al. | 224/245 |
| 5,263,594 | 11/1993 | Bianchi | 211/105.2 |

*Primary Examiner*—Linda J. Sholl
*Attorney, Agent, or Firm*—Palmatier, Sjoquist, Voigt & Christensen, P.A.

[57] ABSTRACT

Disclosed is a system for holding firearm cartridges, such as shotgun shells, and other related accessories. The system may be utilized on wearing apparel such as hunting vests and belts, on structures such as duck boats and blinds, or on vehicles. The system has a rack portion that may be permanently secured to such apparel, structures, or vehicles. Attachable to the rack portion are rigid receivers with cylindrical bores sized to a particular size of cartridge. Each cylindrical bore has a tab extending inwardly into the cylindrical bore that provides an interference fit with the cartridges to secure the cartridges in place. The receiver and the rack portion have cooperating sliding engagement members to removably secure the receivers to the rack portion. The sliding engagement members on the rack portion are arranged on a plurality of sequential segments with breaks between each sequential segment. The rack portion flexes at both ends and at the breaks to allow the rack portion to follow the contours of whatever it may be attached to. Accessory receivers with closeable cases for holding such items as sunglasses, field glasses, or the like may be slidably engaged with the rack portions instead of or in addition to the cartridge receivers.

3 Claims, 2 Drawing Sheets

SHELL HOLDER SYSTEM

BACKGROUND OF THE INVENTION

This invention relates to a holder for firearm cartridges and related accessories. More specifically, it relates to a system suitable for permanent attachment on such items as duck blinds, hunting boats, or the like, that has interchangeable receivers and that can accommodate different sizes of cartridges and other accessories.

Hunters often have a number of different caliber or gauge firearms which they will selectively use for hunting different types of game. Hunting apparel with provisions for receiving shotgun shells or cartridges typically use leather or elastic loops for retaining the cartridges. Said loops are either sized for a particular size shell or will often stretch out with extended use. When this happens the particular piece of hunting apparel becomes useless for its intended purpose of carrying shells.

The prior art shows cartridge holders made of plastic. However, these cartridges do not have provisions for using different sized cartridges in the holder. Moreover these plastic cartridge holders typically utilize latches or tabs positioned above the cartridge to retain the cartridge in place. Use of such tabs can make removal of the cartridges a two-step process. That is, first displacement of the tab and secondly, pushing the cartridge out of position. Oftentimes this may be difficult to do expediently with a single hand.

Applicants are not aware of any prior art cartridge holder systems with interchangeable receivers which are intended for permanent attachment and use on a variety of products from wearing apparel to duck boats, hunting blinds and the like.

SUMMARY OF THE INVENTION

Disclosed is a system for holding firearm cartridges, such as shotgun shells, and other related accessories. The system may be utilized on wearing apparel such as hunting vests and belts, on structures such as duck boats and blinds, or on vehicles. The system has a rack portion that may be permanently secured to such apparel, structures, or vehicles. Attachable to the rack portion are rigid receivers with cylindrical bores sized to a particular size of cartridge. Each cylindrical bore has a tab extending inwardly into the cylindrical bore that provides an interference fit with the cartridges to secure the cartridges in place. The receiver and the rack portion have cooperating sliding engagement members to removably secure the receivers to the rack portion. The sliding engagement members on the rack portion are arranged on a plurality of sequential segments with breaks between each sequential segment. The rack portion flexes at both ends and at the breaks to allow the rack portion to follow the contours of whatever it may be attached to. Accessory receivers with closeable cases for holding such items as sunglasses, field glasses, or the like may be slidably engaged with the rack portions instead of or in addition to the cartridge receivers.

A feature and advantage of the invention is that different receivers may be interchanged on the rack portions. Thus, the rack portions may be permanently mounted at a convenient location on a vest or the like and the rack portions will accommodate different sizes of shotgun shells or various other desired accessories by simply changing the receivers.

A further feature and advantage of the invention is that the fit of shotgun shells in the cylindrical bore of the rigid receiver with the tab biased against each inserted shotgun shell securely retains the shotgun shells in place. The rigid receiver, which may be conveniently formed of molded plastic, will not stretch out as conventional ammunition holders which utilize fabric or leather straps to secure the shells often will, thus providing a very long useful life of the invention. Where a receiver does wear out or otherwise becomes unusable it may simply be replaced. The configuration of the tab, angled in the cartridge insertion direction, allows easy insertion of the cartridges while providing greater resistance for removal.

A further advantage of the invention is that the rack portion may be conveniently mounted on items other than wearing apparel such as boats, blinds, or other structures by conventional attachment techniques such as nailing, riveting, gluing, or the like. The flexible rack portion follows the contours of whatever it is mounted on.

DETAILED DESCRIPTION OF THE PREFERRED EMBODIMENTS

Figure 1:
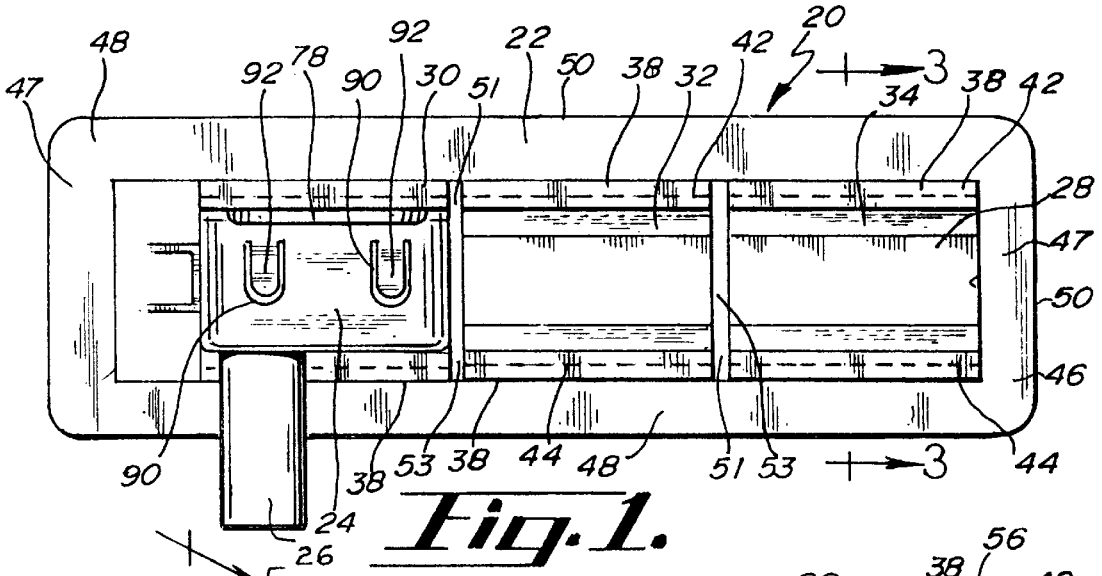
FIG. 1 is a front elevational view of the shell holder system with a shotgun shell receiver in place.
Figure 2:
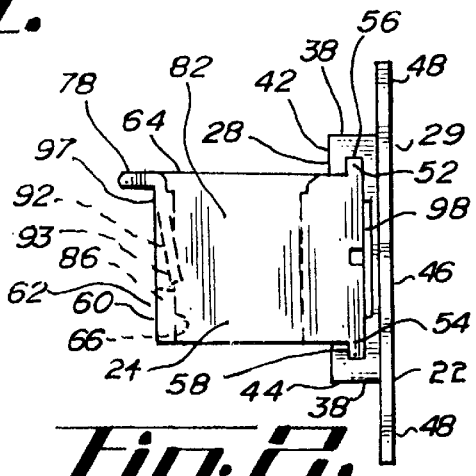
FIG. 2 is an end view of the shell holder system with a cartridge receiver engaged in the rack portion.

Referring to FIGS. 1 and 2, the shell holder system is shown and is generally designated by the numeral 20. The principal components of the shell holder system are a plastic rack portion 22 and a plastic cartridge receiver 24. The receiver 24 is configured to accept two shotgun shells, one of which is shown in place in FIG. 1 and is designated by the numeral 26. The rack portion 22 as shown has a front 28, a back surface 29, and three segments 30, 32, 34, each of which is slidably engagable with the receiver 24 or other appropriately sized receivers. The segments 30, 32, 34 accept and secure the receivers by way of first sliding engagement members 38. The first sliding engagement members 38 on the rack portions 22 each comprise an upper lip portion 42 and a lower lip portion 44. The segments 30, 32, 34 are integral with an elongate and generally rectangular panel portion 46 and are sequentially arranged from end 47 to end 47 on the panel portion 46. The panel portion 46 includes a border portion 48 configured as a ply of plastic extending from the segments 30, 32, 34 to an exterior edge 50 of the panel portion. The ply of plastic is thin enough to allow flexing of the border portion. Gaps or breaks 51 are intermediate each of the segments 30, 32, 34 and the sliding engagement members 38. The gaps or breaks 52 are of substantially the same thickness as the border portion 48, are similarly flexible and thus create a living hinge 53 between each segment 30, 32, 34 permitting the flexing of the rack portion 22 at the gaps or breaks 52. The segments 30, 32, 34 are comparatively rigid due to the added thickness of the engagement members 38 and the material of the segments 30, 32, 34.

Referring to FIGS. 2, 3, 4, and 5, the first sliding engagement members 38 on the rack portion 22 are shown along with their cooperating second sliding engagement members 52, 54 on the receiver 24. The engagement members 52, 54 are configured as edge portions 56, 58 which are integral with and extend from a body portion 60 which engage with grooves 59, 60 defined by the shape of the first sliding engagement members 38 on the rack portion 22. The body portion 60 has a front 62, top surface 64, and a pair of cylindrical bores 66 which extend from the top surface 64 through the body portion 60 to create an open interior 68. The cylindrical bores 66 are sized to frictionally engage a particular selected size of cartridge. The receiver 24 also has an additional chamfer or circumferential recess 72 at the top surface 64 to allow the lip 76 of the shell to be flush with or just below the top surface 64 of the receiver 24.

Figure 4:
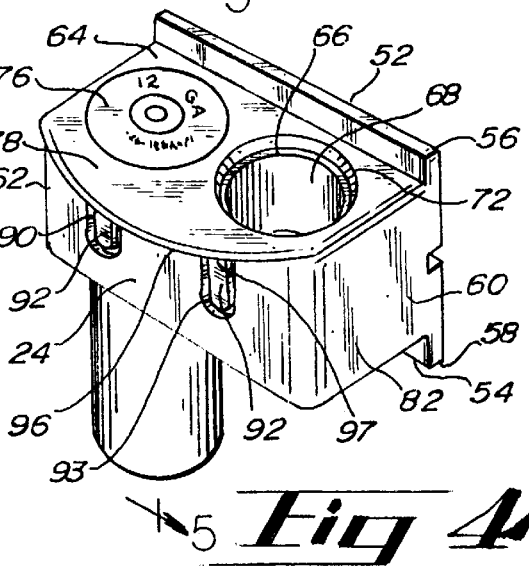
FIG. 4 is a perspective view of the cartridge receiver with a shotgun shell in place.
Figure 5:
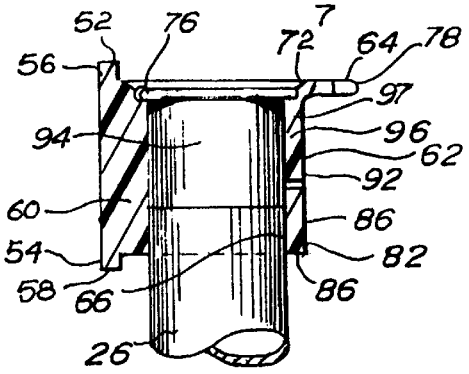
FIG. 5 is a partial sectional view taken through line 5—5 of FIG. 4.
Figure 6:
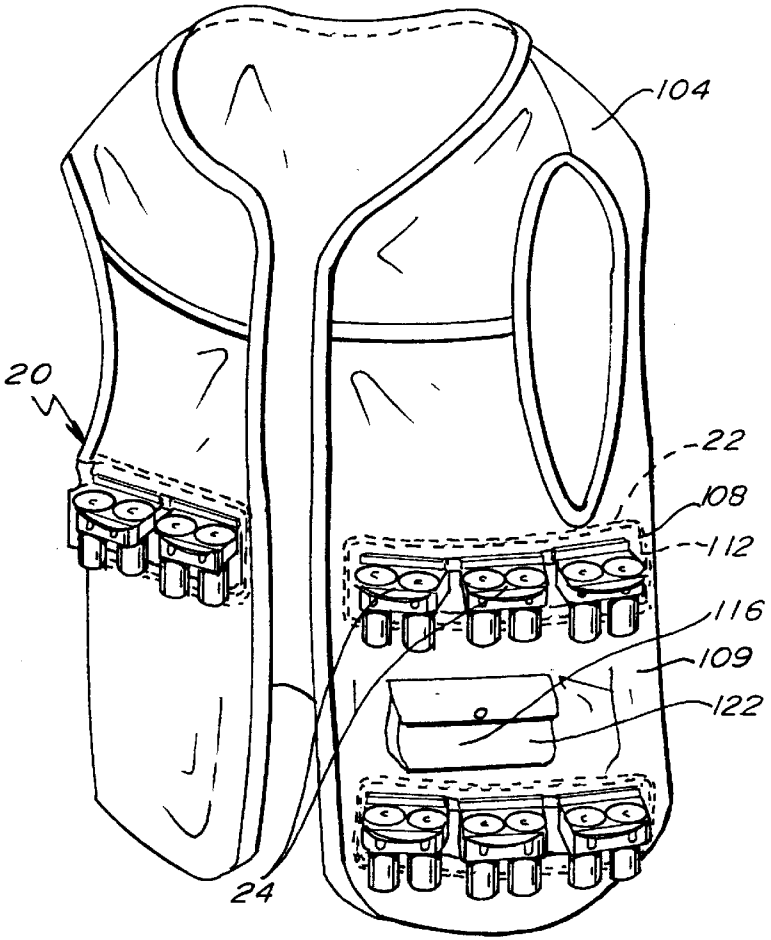
FIG. 6 is a perspective view of a vest utilizing the shell holder system.

The body portion 60 has an exterior surface 82 extending around the receiver 24. As best shown in FIGS. 2 and 5, the receiver 60 has wall portions 86 defined by the cylindrical bores 66 and the outer surface 82. As shown in FIGS. 1 and 4, a U-shaped slit 90 is in each of the two wall portions 86 for each cylindrical bore 66 of the receiver 24. The U-shaped slits 90 each define a tab 92 which is molded to angle inwardly into the cylindrical bore 66 to create an interference fit with any appropriately sized cartridges placed in the receiver 24. With the tab 92 angled inward as shown in FIGS. 2 and 4, a recess 93 exists in the wall portions 86. With a cartridge 26 in place in one of the cylindrical bores 66, such as shown in FIGS. 4 and 6, the tab is flexed outwardly into the recess 93 to be in substantial alignment with the rest of the wall portion 86 as best shown in FIG. 5. Said outward bending provides a stress in the tab 92 which results in the tab 92 pressing upon the upper portion 94 of the shell 26. The tab flexes primarily at its upper portion 97.

Figure 3:
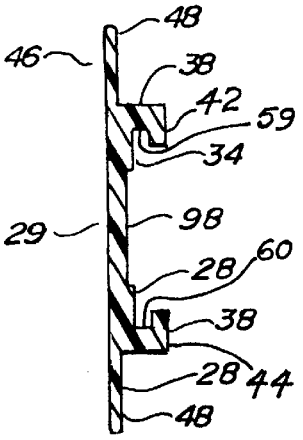
FIG. 3 is a cross-sectional view taken at line 3—3 of FIG. 1.

As shown in FIG. 3, the panel portion 46 and the segments 30, 32, 34 comprised of the sliding engagement members 38, may be formed integral with each other such as by injection molding. The border portion 48 is thin enough to provide flexibility and to allow easy puncturing such as for stitching the rack portion 22 onto desired apparel such as a vest or belt. Moreover, a recess 98 in each segment 30, 32, 34 allows stitching or other attachment means such as rivets, screws, or nails, to be inserted through the segments such that said attachment means do not interfere with the receivers 24. Dupont Zytel FN 727 has been found to be a suitable material for the rack portion 22. The rigid cartridge receivers 24 may be injection molded from the Delrin SOOP also available from Dupont. The first sliding engagement members 38 and the cooperating second sliding second engagement members 52 are suitably sized to allow sliding engagement of the receiver 24 onto the rack portion 22 by hand and tight enough to avoid inadvertent disengagement.

Figure 7:
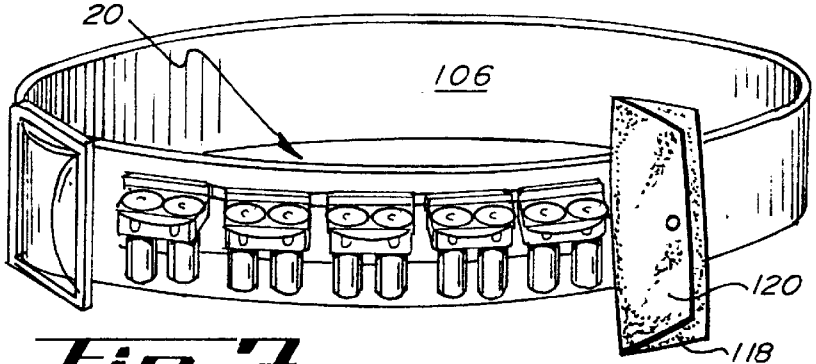
FIG. 7 is a perspective view of a belt utilizing the shell receiver system.

Referring to FIGS. 6 and 7, the shell holder system 20 is shown being utilized on a hunting vest 104 and a belt 106. The rack portion 22 may be suitably attached to the vest 104 by utilization of a rectangular aperture 108 placed in the vest sized to allow sequential segments 30, 32, 34 to extend through the aperture 106 to allow the receivers 24 to be positioned on the exterior 109 of the vest 104 with the border portion on the interior of the vest 111. The border portion 48 may be suitably attached to the vest 104 such as by stitching 112.

Figure 8:
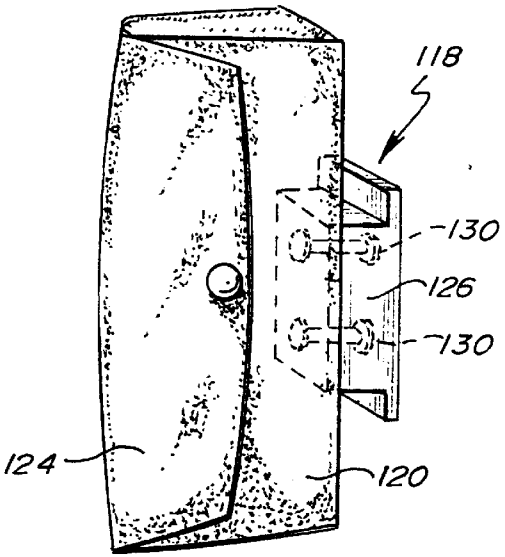
FIG. 8 is a detailed perspective view of a receiver with a case portion.

FIGS. 6, 7, and 8 show receivers 116, 118 with closable case portions 120, 122. FIG. 8 is a detail of such a receiver 118 with the case portion 120 including a closable cover 124. The case portion 120 is suitably attached to the body portion 126 by way of rivets 130, or other conventional attachment means. The receiver 118 is configured to hold sunglasses, not shown.

The system operates as follows: The rack portion 22 is attached to the desired article of wearing apparel, structure or object. Such would include duck blinds, boats, all-terrain vehicles, trees, or any other convenient location. The panel portion 46 is relatively thin-walled and is flexible particularly at the breaks 52 between the segments 30, 32, 24 which constitute living hinges 53. Thus, the rack portion 22 can be bent around, or contoured, to fit curved surfaces such as tree trunks or an individual's torso.

Desired receivers such as the shotgun shell receivers are then slidably inserted into one of the ends of the rack portion 22 and may be slid past the breaks 52 to reach centrally positioned segments such as the middle engagement segment 32 of FIG. 1.

With reference to the cartridge receivers, the cartridges are inserted into the cylindrical bore commencing at the top surface 64 of the receiver 24. The cylindrical bores 66 are suitably sized to allow a sliding friction fit. The insertion of the shotgun shells into the bores 66 retract the tabs 92 from the interior 68 of the cylindrical bores. The retraction provides an inward bias that acts on the upper portion 94 of the shotgun shell 26 when it is in place to secure said shell 26 in place. When removal of the shell 26 is desired, an upward pressure is exerted underneath the shell. For example, the forefinger may be utilized to push upwardly and the user's thumb may be used to contact the top surface 64 and the lip 78 of the receiver 24 to provide suitable leverage for easy removal of the shell.

When it is desired to use the system 20 with a different size cartridge or with an accessory receiver, the receivers in place are simply slid out of the rack portion 22 and are replaced with receivers with the desired sized cylindrical bore or attached case.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A holder system for wearing apparel comprising:

a) an elongate plastic rack portion comprising an elongate panel portion having a back surface and a front, a plurality of sequentially positioned segments, each segment integral with the panel portion and having a sliding engagement member on the front of the panel portion, the panel portion being flexible at each break intermediate the segments the panel portion further comprising a flexible ply of plastic for attachment to the wearing apparel, the ply extending around the sequentially positioned segments and integral with said segments; and b) a plurality of rigid receivers, each receiver comprising a body portion with a plurality of cylindrical bores for insertion and removal of cartridges and a cooperating sliding engagement member on the body portion, the cooperating sliding engagement members sized and positioned to be engagable with the sliding engagement members of the segments, whereby each receiver is slidably engagable with the rack portion and each receiver is removable and replaceable from the rack portion.

2. The system of claim 1, wherein there is a break on the panel portion intermediate each sequential segment, the panel portion thin enough such that said rack portion is flexible at each break.

3. The system of claim 1, wherein each receiver further comprises a closeable case portion attached to the body portion.

* * * * *